US007149455B2

(12) United States Patent
Hattori

(10) Patent No.: US 7,149,455 B2
(45) Date of Patent: Dec. 12, 2006

(54) IMAGE FORMING DEVICE HAVING A CLEANING MEMBER FOR CLEANING AN IMAGE FORMATION SURFACE

(75) Inventor: Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/896,236

(22) Filed: Jul. 22, 2004

(65) Prior Publication Data

US 2005/0019073 A1 Jan. 27, 2005

(30) Foreign Application Priority Data

Jul. 23, 2003 (JP) ..... 2003-278127

(51) Int. Cl.
*G03G 21/00* (2006.01)

(52) U.S. Cl. ..... 399/98; 399/99

(58) Field of Classification Search ..... 399/98, 399/99, 388, 401, 402, 406, 381
See application file for complete search history.

(56) References Cited

U.S. PATENT DOCUMENTS 5,182,694 A * 1/1993 Endo ..... 361/229
5,383,011 A * 1/1995 Numagami et al. ..... 399/358
5,532,798 A * 7/1996 Nakagami et al. ..... 399/170
5,870,654 A * 2/1999 Sato et al. ..... 399/109
6,219,505 B1 4/2001 Sato et al. ..... 399/98
6,415,119 B1 7/2002 Nishimura et al. ..... 399/98
6,505,019 B1 1/2003 Sato et al. ..... 399/98
6,708,009 B1 3/2004 Fuwazaki et al. ..... 399/98
2001/0026705 A1 10/2001 Sato ..... 399/98
2003/0049043 A1* 3/2003 Fuwazaki et al. ..... 399/98
2005/0201774 A1* 9/2005 Yamagata ..... 399/98

FOREIGN PATENT DOCUMENTS

JP A2003-81476 3/2003

* cited by examiner

*Primary Examiner*—Anthony H. Nguyen
(74) *Attorney, Agent, or Firm*—Oliff & Berridge, PLC

(57) ABSTRACT

An image forming device includes an image forming section, a plurality of recording-medium supply units, a transportation guide forming a plurality of transportation paths, a full-width cleaning member, a plurality of recording-medium separating members, and at least one partial cleaning member provided for each recording-medium separating member. The plurality of transportation paths joins together to provide a single main transportation path reaching the image forming section. The full-width cleaning member is disposed in the single main transportation path. The full-width cleaning member has a full-width cleaning portion wider than a recording medium. Each partial cleaning member has a partial cleaning portion wider than is the corresponding recording-medium separating member.

14 Claims, 4 Drawing Sheets

IMAGE FORMING DEVICE HAVING A CLEANING MEMBER FOR CLEANING AN IMAGE FORMATION SURFACE

BACKGROUND OF THE INVENTION

1. Field of the Invention

The present invention relates to an image forming device such as a laser printer.

2. Description of Related Art

An image forming device such as a laser printer is usually provided with a paper feed mechanism for feeding paper and an image forming mechanism for forming an image on the fed paper.

The paper feed mechanism is provided with a paper feed tray in which paper is stacked in a pile, and a paper feed roller and a paper feed pad disposed above one end of the paper feed tray and disposed to confront each other. Paper at the top of the paper feed tray is pinched between the paper feed roller and the paper feed pad by rotation of the paper feed roller, and is fed one sheet at a time.

The image forming mechanism is provided with a photosensitive drum and, around the photosensitive drum, a charging device, a scanner device, a developing roller, and a transfer roller, in that order following the direction of rotation of the photosensitive drum. As the photosensitive drum rotates, the surface of the photosensitive drum is first uniformly charged by the charging device, then exposed by high-speed laser beam scan from the scanner device, and an electrostatic latent image is formed based on predetermined image data. Next, through rotation of the developing roller, toner held on the developing roller is supplied to the electrostatic latent image formed on the surface of the photosensitive drum and held selectively, whereby a visible image is formed. Then, while paper fed from the paper feed mechanism passes between the photosensitive drum and the transfer roller, the visible image held on the surface of the photosensitive drum is transferred to the paper, thereby forming a predetermined image on the paper.

In the above-described image forming device, since paper is fed one sheet at a time while being pinched between the paper feed roller and the separation pad, paper dust may be generated on the paper due to friction between the paper feed roller and the separation pad. In addition, foreign matter such as paper dust may be generated over the entirety of the paper when the paper is cut. If such paper dust mixes with the toner in the image forming mechanism, a problem of image quality degradation will occur.

Accordingly, for example, Japanese patent-application publication No. 2003-81476 discloses a device in which a paper dust removing roller of approximately the same width as the separation pad, and a paper dust removing roller of approximately the same width as the paper, are disposed downstream of the paper feed roller in the paper transportation direction. Thus, paper dust generated on paper can be eliminated in a well-balanced manner before the paper is transported to the image forming mechanism.

SUMMARY OF THE INVENTION

However, in the device disclosed in Japanese patent-application publication No. 2003-81476, the dust removing rollers of approximately the same width as the paper are not provided for all paper feed paths, resulting in a problem of failing to eliminate paper dust generated on paper in a well-balanced manner for all the paper used.

In view of the above-described drawbacks, it is an objective of the present invention to provide an image forming device that can eliminate foreign matter effectively, and can form high-quality images, for paper transported from any paper feed path in the image forming device.

In order to attain the above and other objects, the present invention provides an image forming device. An image forming device includes an image forming section, a plurality of recording-medium supply units, a transportation guide, a full-width cleaning member, a plurality of recording-medium separating members, and at least one partial cleaning member provided for each recording-medium separating member. The image forming section forms an image on an image formation surface of a recording medium. The recording medium has a width in a widthwise direction orthogonal to a recording-medium transportation direction. Each of the plurality of recording-medium supply units supplies the image forming section with the recoding medium. The transportation guide forms a plurality of transportation paths. Each transportation path connects a corresponding one of the plurality of recording-medium supply units to the image forming section. The recording medium is transported from each recording-medium supply unit to the image forming section in the recording-medium transportation direction. The plurality of transportation paths joins together to provide a single main transportation path reaching the image forming section. The full-width cleaning member is disposed in the single main transportation path. The full-width cleaning member is contactable with the image formation surface of the recording medium. The full-width cleaning member has a full-width cleaning portion for removing foreign matter adhering to the image formation surface of the recording medium. The full-width cleaning portion has a first width greater than the width of the recording medium in the widthwise direction. Each of the plurality of recording-medium separating members is disposed at a position, in each of the plurality of transportation paths, between a corresponding recording-medium supply unit and the full-width cleaning member. Each recording-medium separating member is contactable with one surface of the recording medium, thereby separating only one sheet of the recording medium to be transported downstream. Each recording-medium separating member has a second width in the widthwise direction smaller than the width of the recording medium. The at least one partial cleaning member is provided for each recording-medium separating member. The at least one partial cleaning member is disposed at a position, in a corresponding transportation path, between a corresponding recording-medium separating member and the image forming section. Each partial cleaning member is contactable with the one surface of the recording medium. Each partial cleaning member has a partial cleaning portion for removing foreign matter adhering to the one surface of the recording medium. The partial cleaning portion has a third width greater than the second width of the corresponding recording-medium separating member.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is a cross-sectional view of a third paper dust removing roller in the laser printer shown in FIG. 1;

FIG. 3(*c*) is a cross-sectional view of a first paper dust removing roller and a second paper dust removing roller in the laser printer shown in FIG. 1;

FIG. 3(*d*) is a cross-sectional view of a pad member in the laser printer shown in FIG. 1.

DETAILED DESCRIPTION OF THE PREFERRED EMBODIMENTS

An image forming device according to a preferred embodiment of the present invention will be described while referring to the accompanying drawings.

Figure 1:
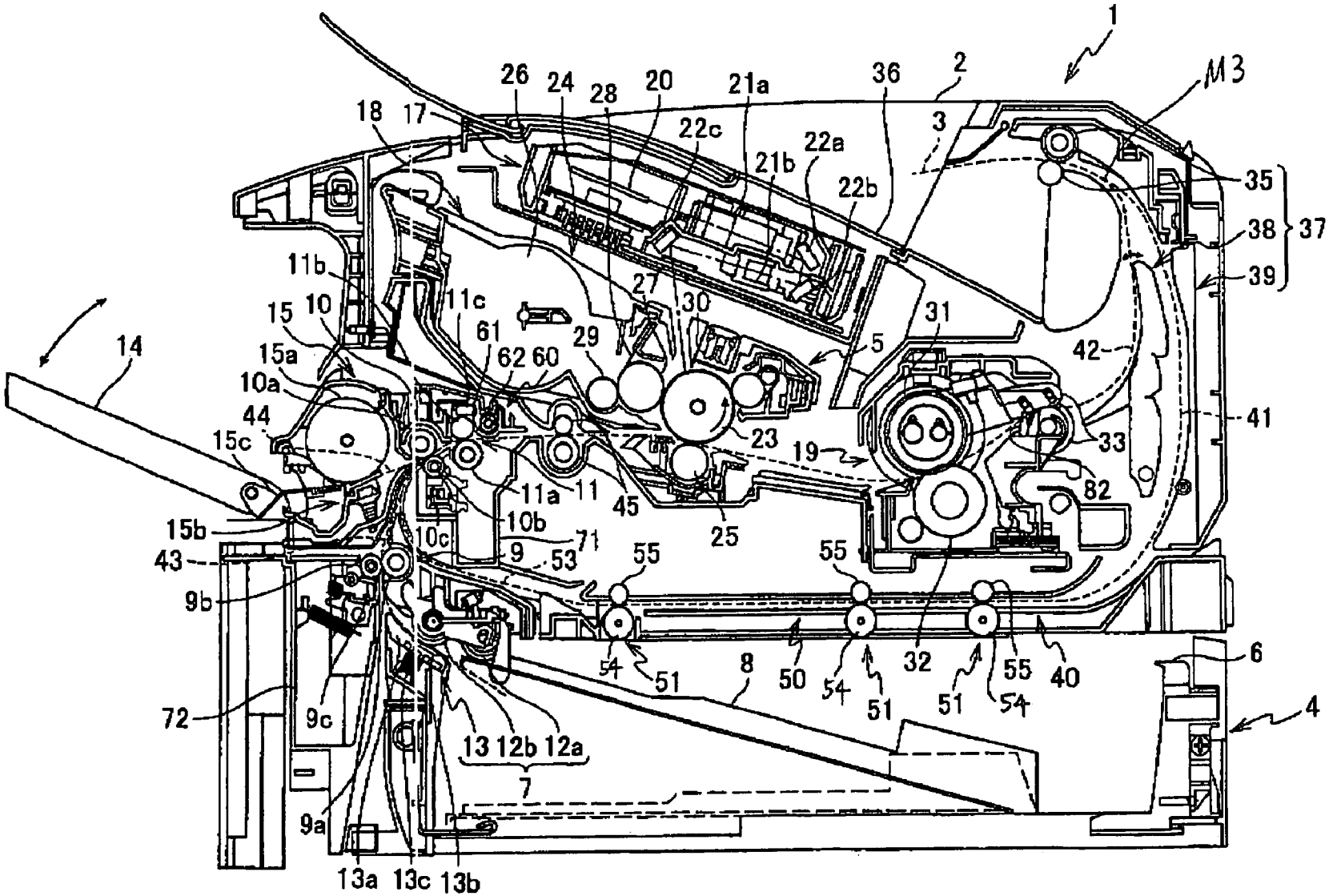
FIG. 1 is a side cross-sectional view showing principal parts of a laser printer according to an embodiment of the present invention.

As shown in FIG. 1, a laser printer 1 forms an image by electrophotography, and is provided with, in a main casing 2, a paper supply cassette 4 for feeding paper 3 as a recording medium, an image forming section 5 for forming predetermined images on the fed paper 3, and so forth.

The paper supply cassette 4 is disposed, in the bottom area within the main casing 2. The paper supply cassette 4 includes a removable paper feed tray 6, a paper feed mechanism section 7 fitted to one end of the paper feed tray 6, a paper pressure plate 8 fitted inside the paper feed tray 6, a first transportation section 9 located downstream in a paper transportation direction with respect to the paper feed mechanism section 7 (hereinafter, "upstream in the paper transportation direction" and "downstream in the paper transportation direction" may be referred to simply as "upstream" and "downstream"), a second transportation section 10 and a third transportation section 11, and registration rollers 45 located downstream in the paper transportation direction with respect to the first transportation section 9 and the second transportation section 10.

The paper feed tray 6 is box-shaped and has a top that can be opened to allow the paper 3 to be accommodated. The paper feed tray 6 can be inserted into and removed from the bottom part of the main casing 2 horizontally.

Figure 2:
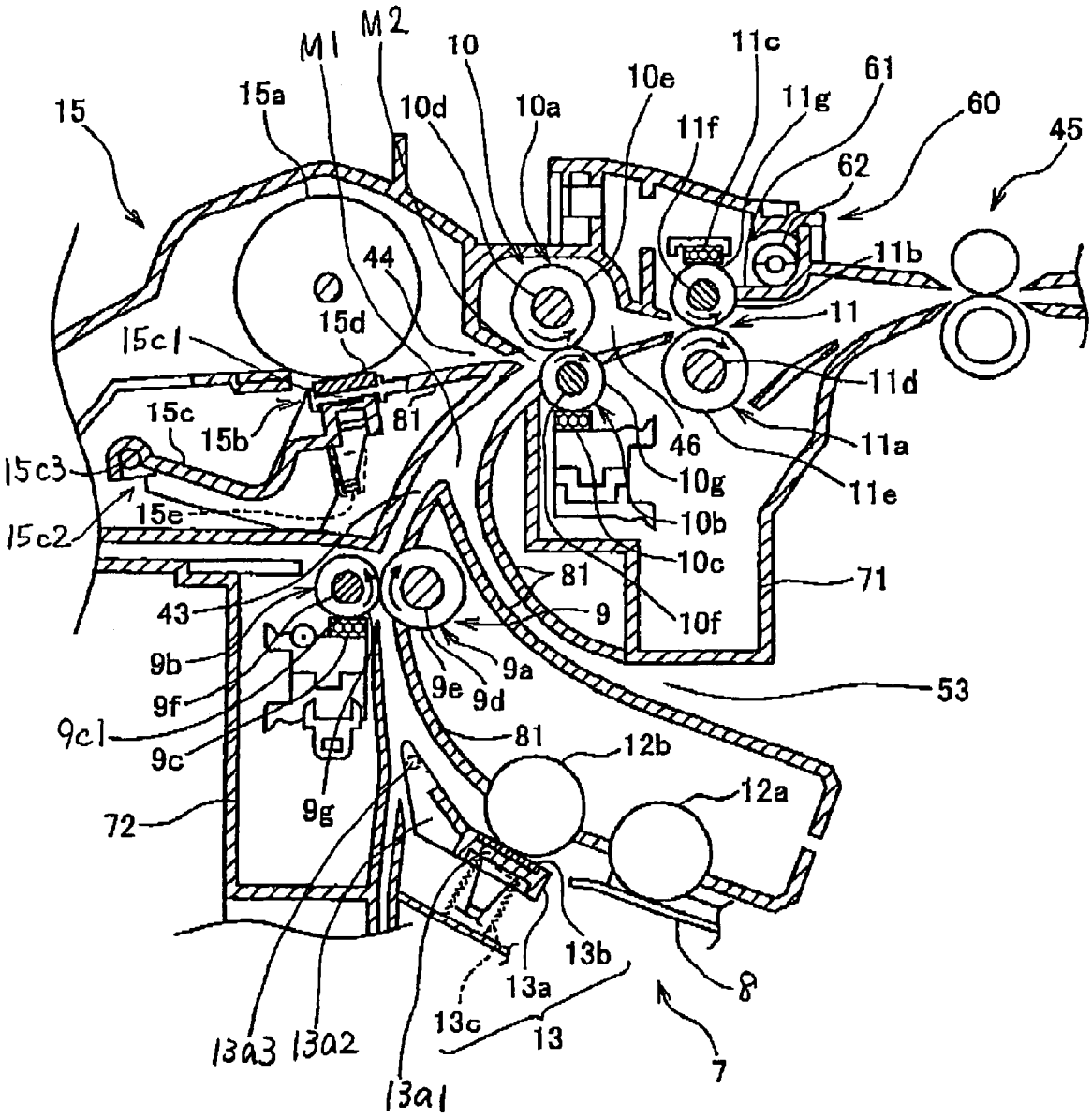
FIG. 2 is an enlarged side cross-sectional view showing paper feed transportation paths of the laser printer shown in FIG. 1.
Figure 3A:
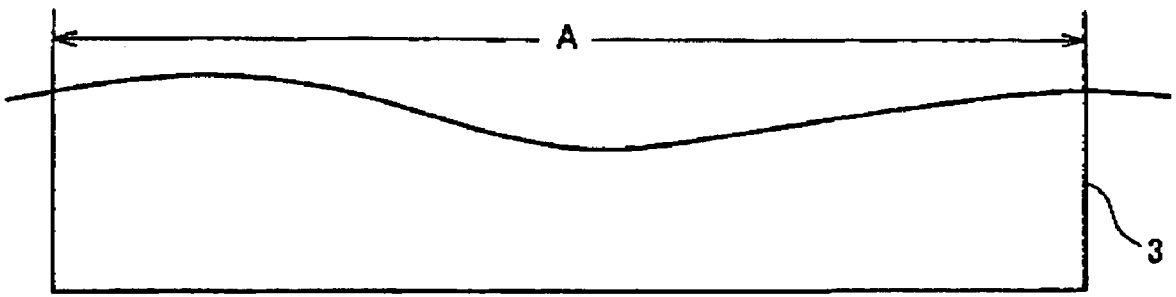
FIG. 3(*a*) is a plan view of paper used in the laser printer shown in FIG. 1.
Figure 3B:
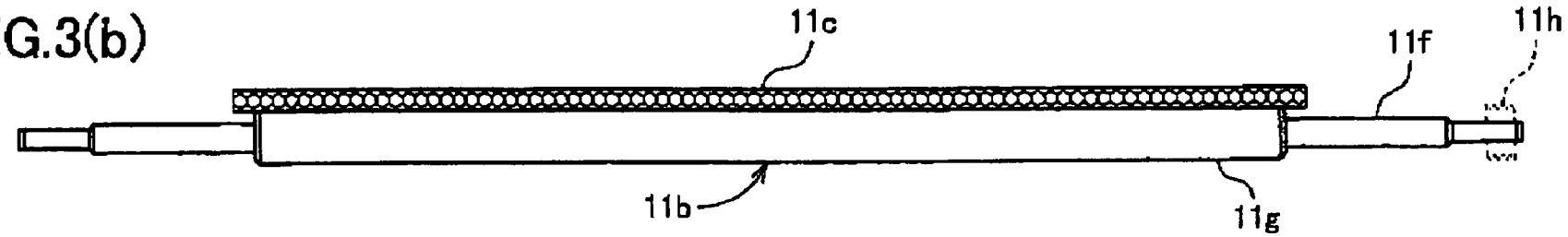
Figure 3C:
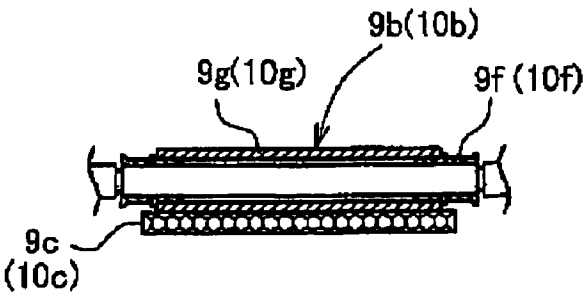
Figure 3D:
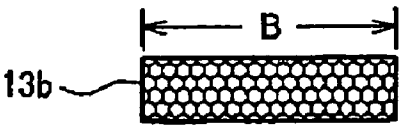

As shown in FIGS. 1 and 2, the paper feed mechanism section 7 includes a pickup roller 12*a* that picks up the paper 3 on the paper pressure plate 8, a separation roller 12*b* that has a surface with a higher coefficient of friction than a coefficient of friction of a pad member 13*b* described later, and a separation pad 13 confronting the separation roller 12*b*. The separation pad 13 includes a support frame 13*a*, the pad member 13*b*, and a spring 13*c*.

The pickup roller 12*a* picks up the paper 3 on the paper pressure plate 8, and feeds the paper 3 to the separation roller 12*b* side in a first transportation path 43.

The separation roller 12*b* is positioned in the first transportation path 43 so as to pinch the paper 3 picked up by the pickup roller 12*a* between the separation roller 12*b* and the pad member 13*b*, such that one sheet of the paper 3 is transported downstream in the paper transportation direction.

As shown in FIG. 2, the support frame 13*a* includes a flat plate-shaped member 13*a*1 and a support member 13*a*2, and is formed as a member with an L-shaped cross section. The flat plate-shaped member 13*a*1 is disposed below the separation roller 12*b* and confronts the separation roller 12*b*. The support member 13*a*2 is connected to one end of the flat plate-shaped member 13*a*1, and is formed to bend downward approximately at a right-angle from the one end of the flat plate-shaped member 13*a*1. An upper end portion 13*a*3 of the support member 13*a*2 is pivotally supported to a casing (not shown), such that the separation pad 13 can be pivotally moved. The pad member 13*b* is inset in a concave portion on the side of the flat plate-shaped member 13*a*1 that confronts the separation roller 12*b*. The spring 13*c* is disposed on the other side that is an opposite side to the separation roller 12*b*. The spring 13*c* urges the flat plate-shaped member 13*a*1, such that the pad member 13*b* is pressed against the separation roller 12*b*.

As shown in FIG. 3(*d*), the pad member 13*b* has an approximately rectangular plate shape and is formed from a urethane rubber or similar elastic member. A width B of the pad member 13*b* in the widthwise direction orthogonal to the paper transportation direction (hereinafter "width in the direction orthogonal to the paper transportation direction" may be referred to simply as "width") is smaller than a width A of the paper 3 shown in FIG. 3(*a*). The width A is the maximum width of the paper 3 for which printing can be performed by the laser printer 1. In other words, the pad member 13*b* has a width that provides contact with only the widthwise center part of the paper 3 for feeding the paper 3.

As shown in FIG. 1, the paper pressure plate 8 allows the paper 3 to be stacked in a pile. The paper pressure plate 8 is pivotally supported about the farther end from the pickup roller 12*a*, enabling its nearer end to move up and down. The paper pressure plate 8 is raised by a pressure plate raising mechanism (not shown). At this time, topmost paper 3 contacts the pickup roller 12*a* and further raises the pickup roller 12*a*, and stops at a position at which a sensor (not shown) detects the pickup roller 12*a*. The pickup roller 12*a* is forced downward by a spring (not shown) and is pressed against the paper pressure plate 8. Then the topmost paper 3 is picked up by the rotation of the pickup roller 12*a* and transported to the separation roller 12*b*. By being pinched between the separation roller 12*b* and the pad member 13*b*, the paper 3 is separated and fed one sheet at a time by the cooperative action of the separation roller 12*b* and the pad member 13*b*. The first transportation path 43 is formed by a transportation guide 81 between the paper feed mechanism section 7 and the image forming section 5. The fed paper 3 is sent to the registration rollers 45 by the first transportation section 9, the second transportation section 10, and the third transportation section 11, along the first transportation path 43. The registration rollers 45 include a pair of rollers. The registration rollers 45 send the paper 3 to the image forming section 5 after predetermined registration of the paper 3.

As shown in FIG. 1, the image forming section 5 includes a scanner section 17, a process section 18, a fixing section 19, and so forth.

The scanner section 17 is disposed in an upper area within the main casing 2, and includes a laser emitting section (not shown), a polygonal mirror 20, lenses 21*a* and 21*b*, reflecting mirrors 22*a* through 22*c*, and so forth. In the scanner section 17, a laser beam based on predetermined image data emitted from the laser emitting section is irradiated through or reflected from the polygonal mirror 20, the lens 21*a*, the reflecting mirrors 22*a* and 22*b*, the lens 21*b*, and the reflecting mirror 22*c*, in this order, as shown by the single-dot chain line, and is irradiated onto the surface of a photosensitive drum 23 of the process section 18 in a high-speed scan.

The process section 18 is positioned below the scanner section 17, and is detachably mounted in the main casing 2.

The process section 18 includes the photosensitive drum 23, a developing cartridge 24, a transfer roller 25, and a scorotron-type charger 30. The developing cartridge 24 is detachably mounted to the process section 18, and includes a toner container 26, a developing roller 27, a thickness regulating blade 28, a toner supply roller 29, and so forth.

The toner container 26 is filled with positively charged, non-magnetic, single-component polymer toner. The toner is supplied to the developing roller 27 by the toner supply roller 29, and is held on the developing roller 27 as a thin layer of a certain thickness by the scraping action of the thickness regulating blade 28. The photosensitive drum 23 is positioned to confront the developing roller 27, and is rotatable. The drum body of the photosensitive drum 23 is grounded, and is formed of a positively-charged photosensitive layer formed from polycarbonate or the like.

As the photosensitive drum 23 rotates in the direction indicated by the arrow, the surface of the photosensitive drum 23 is uniformly positively charged by the scorotron-type charger 30, and is then exposed by a high-speed laser S beam scan by the scanner section 17, and an electrostatic latent image is formed. Subsequently, when the photosensitive drum 23 is opposed to the developing roller 27, the positively-charged toner held on the developing roller 27 is supplied to and selectively held by the electrostatic latent image formed on the surface of the photosensitive drum 23, that is, portions exposed by the laser beam and whose potential has fallen on the surface of the uniformly positively-charged photosensitive drum 23. In this way, the image becomes visible and transfer developing can be performed.

The transfer roller 25 is located below and confronts the photosensitive drum 23. The transfer roller 25 has a roller of conductive rubber material covering a metallic roller shaft, and has a predetermined transfer bias applied with respect to the photosensitive drum 23. Thus, the visible image held on the photosensitive drum 23 is transferred to the paper 3 while the paper 3 passes between the photosensitive drum 23 and the transfer roller 25. Then the paper 3 onto which the visible image has been transferred is transported to the fixing section 19.

The fixing section 19 is located downstream of the process section 18. The fixing section 19 includes a heating roller 31, a pressure roller 32 that applies pressure to the heating roller 31, and a transport rollers 33 located downstream of the heating roller 31 and the pressure roller 32.

The heating roller 31 is metallic and is provided with a halogen lamp for heating. While the paper 3 passes between the heating roller 31 and the pressure roller 32, the heating roller 31 heat-fixes the toner transferred onto the paper 3 in the process section 18. Then the paper 3 is transported to the paper discharge rollers 35 by the transport rollers 33 of the fixing section 19. After being transported to the paper discharge rollers 35, the paper 3 is discharged onto a discharge tray 36.

A paper sensor 82 is disposed between the heating roller 31 and the transport rollers 33. At the time of reverse transportation of the paper 3 described later, when the rear end of the paper 3 is detected by the paper sensor 82, the paper discharge rollers 35 are switched from forward rotation to reverse rotation at predetermined timing after the detection timing.

With the laser printer 1, the developing roller 27 recovers residual toner remaining on the surface of the photosensitive drum 23 after the transfer roller 25 has performed transfer. That is, the residual toner is recovered by a so-called cleanerless developing method since the residual toner is recovered by the cleanerless developing method, there is no need for a special member such as a blade for storing removing residual toner, or for a storage section for waste toner, thereby simplifying the device configuration.

The laser printer 1 is provided with the reverse mechanism 37 that reverses the paper 3, and a retransportation tray 40 that retransports the paper 3 to the image forming section 5 in order to form images on both sides of the paper 3. The reverse mechanism 37 includes the paper discharge rollers 35, a flapper 38, and a reverse guide 39. The reverse mechanism 37 and the retransportation tray 40 may be integrated and detachably mounted to the main casing 2 as a unit.

The paper discharge rollers 35 include a pair of rollers, and enable switching between forward and reverse rotation. As described above, when the paper 3 is to be discharged onto the discharge tray 36, the paper discharge rollers 35 rotate in the forward direction and transport the paper 3 in the paper transportation direction. However, when the paper 3 is to be reversed and transported in the reverse direction, the paper discharge rollers 35 rotate in the reverse direction.

The reverse guide 39 forms a reverse transportation path 41 in a vertical direction together with the flapper 38 so that the paper 3 can be transported from the paper discharge rollers 35 to the retransportation tray 40 located below the image forming section 5. The upstream end of the reverse transportation path 41 is located near the paper discharge rollers 35 and the downstream end thereof is located near the retransportation tray 40. In the reverse transportation path, the paper 3 is transported with its widthwise center as a reference (instead of transporting the paper 3 with its widthwise end as a reference), which is so-called center registration feed.

The flapper 38 is provided near a junction position M3 that is a junction of a paper discharge path 42 and the reverse transportation path 41. The flapper 38 can be pivotally moved. More specifically, the flapper 38 can switch the transportation direction of the paper 3 reversed by the paper discharge rollers 35, from the direction toward the paper discharge rollers 35 to the direction toward the retransportation tray 40 in accordance with excitation or non-excitation of a solenoid (not shown).

The retransportation tray 40 is approximately plate-shaped, and is disposed approximately horizontally above the paper feed tray 6. The upstream end of the retransportation tray 40 is located near the rear end of the reverse transportation path 41, and the downstream end is located below the registration rollers 45.

The reverse mechanism 37 is operated as described below. When the paper 3 with an image formed on one side is fed from the paper discharge path 42 to the paper discharge rollers 35 by the transport rollers 33, the paper discharge rollers 35 rotate forward while pinching the paper 3 and transport the paper 3 initially toward the outside (the discharge tray 36 side). Subsequently, when a greater part of the paper 3 has been fed toward the outside and the rear end of the paper 3 is between the paper discharge rollers 35, forward rotation is halted. Next, the paper discharge rollers 35 rotate in the reverse direction, and the flapper 38 switches the transportation direction so that the paper 3 is transported to the reverse transportation path 41. Thus, the paper 3 is transported to the reverse transportation path 41 with its lengthwise direction reversed. The timing for switchover of the paper discharge rollers 35 from forward to reverse rotation is controlled so as to be a predetermined time after the rear end of the paper 3 is detected by the paper sensor 82, as described above. When transportation of the paper 3 ends, the flapper 38 is switched to its original state, that is, the state in which the paper 3 fed from the transport rollers 33 is fed to the paper discharge rollers 35. Next, the paper 3 transported in the reverse direction to the reverse transportation path 41 is further transported to the retransportation tray 40. Then, the paper 3 is transported upward from the retransportation tray 40, and transported to the registration rollers 45. The paper 3 transported to the registration rollers 45 has predetermined registration applied again in the reversed state, and is then sent toward the image forming section 5, by which a predetermined image is formed on the reverse side of the paper 3.

The retransportation tray 40 includes a tray body 50 and oblique rollers 51. The tray body 50 has an approximately rectangular plate shape, and is disposed approximately horizontally above the paper feed tray 6. The upstream end of the tray body 50 is connected to the reverse guide 39. The downstream end of the tray body 50 is connected to a retransportation path 53 that is connected to the first transportation path 43, in order to guide the paper 3 from the tray body 50 to the second transportation section 10.

The three oblique rollers 51 are provided in the tray body 50 at predetermined intervals along the paper transportation direction for transporting the paper 3. The paper 3 is transported while in contact with a reference plate (not shown).

Each oblique roller 51 is provided with an oblique drive roller 54 and an oblique follow roller 55. The oblique drive roller 54 is located near the reference plate (not shown) disposed at one widthwise end of the tray body 50. The axes of the oblique drive rollers 54 are positioned 5 in a direction approximately orthogonal to the paper transportation direction. The oblique follow roller 55 confronts the oblique drive roller 54 and sandwiches the paper 3 with the oblique drive roller 54. The axes of the oblique follow rollers 55 are positioned such that the paper 3 is transported in a direction oblique with regard to the paper transport direction toward the reference plate.

The paper 3 sent from the reverse transportation path 41 to the tray body 50 is transported by the oblique rollers 51 via the retransportation path 53 while one widthwise edge of the paper 3 is in contact with the reference plate, and toward the image forming section 5, with the front and back reversed. When the paper 3 is transported to the image forming section 5, the rear surface thereof is brought into contact with the photosensitive drum 23, the visible image is transferred and then fixed by the fixing section 19, and the paper 3 is discharged to the discharge tray 36 with images formed on both sides.

Figure 4:
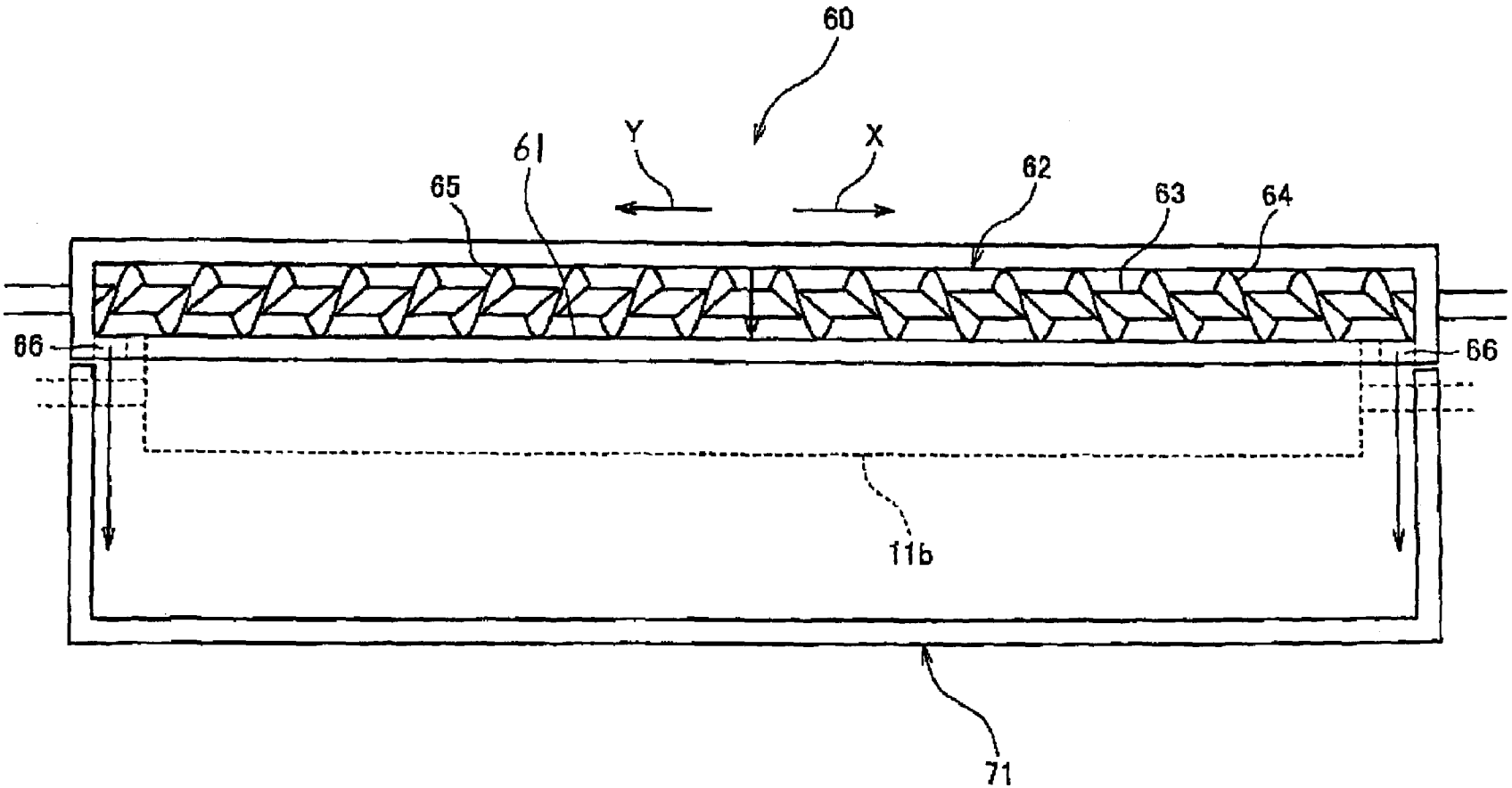
FIG. 4 is a side view of a paper dust transportation section of the laser printer shown in FIG. 1.

As shown in FIG. 2, the laser printer 1 is provided with the first transportation section 9, the second transportation section 10, and the third transportation section 11, all positioned in the first transportation path 43. With this construction, the laser printer 1 can remove, in a well-balanced manner, paper dust originally generated on the entire paper 3 when the paper 3 is cut and paper dust generated on the surface of the paper 3 due to friction between the pad member 13*b* and the separation roller 12*b* of the paper feed mechanism section 7. Also, as shown in FIG. 4, a paper dust transportation section 60 is provided to transport paper dust removed by the third transportation section 11 to a storage tank 71 described later.

The relationships among the transportation paths 43, 44, 46, and 53 are described. The first transportation path 43, the second transportation path 44, the transportation path 46, and the retransportation path 53 are formed by the transportation guide 81. The first transportation path 43 is formed to pass through the paper feed mechanism section 7, the first transportation section 9, the second transportation section 10, and the third transportation section 11. The second transportation path 44 is formed to pass through the multipurpose paper feed mechanism section 15, the second transportation section 10, and the third transportation section 11. The retransportation path 53 joins or merges with the first transportation path 43 at a junction position M1. The first transportation path 43 and the second transportation path 44 joins with each other at a junction position M2. Thus, the first transportation path 43 and the second transportation path 44 overlaps in a section downstream of the junction position M2. The transportation path 46 is formed in the overlapped section between the junction position M2 and the registration rollers 45. In other words, the transportation path 46 is a part of the first transportation path 43 and the second transportation path 44.

The first transportation section 9 is positioned downstream in the paper transportation direction with respect to the separation roller 12*b* of the paper feed mechanism section 7 at the forward portion of the first transportation path 43. The first transportation section 9 is positioned at a predetermined distance from the separation roller 12*b* and further upstream than the junction position M1 in the first transportation path 43. The first transportation section 9 includes a first transportation roller 9*a* that transports the paper 3, a first paper dust removing roller 9*b* confronting the same surface of the paper 3 as the surface confronting the separation pad 13, and a first sponge member 9*c* positioned below the first paper dust removing roller 9*b*.

The first transportation roller 9*a* confronts the first transportation path 43 from the inner side. The first transportation roller 9*a* has a metallic roller shaft 9*d* covered with a rubber roller 9*e*, and is rotatable in the direction indicated by the arrow (clockwise direction in FIG. 2) by the power transmitted from a motor (not shown).

The first paper dust removing roller 9*b* confronts the first transportation path 43 from the outer side. The first paper dust removing roller 9*b* has a metallic roller shaft 9*f* covered with a resin roller 9*g* whose surface is easily charged. The resin roller 9*g* is, for example, a roller of fluororesin or a roller with a fluororesin coated surface. As shown in FIG. 3(*c*), the first paper dust removing roller 9*b* is positioned in an approximately center position with respect to the first transportation roller 9*a*, such that the first paper dust removing roller 9*b* overlaps the separation pad 13 in the paper transportation direction. Accordingly, the first paper dust removing roller 9*b* can contact the surface of the paper 3 that has contacted the pad member 13*b* (the image formation surface). More specifically, the first paper dust removing roller 9*b* can contact a part that has contacted the pad member 13*b* (the approximately center part). The width of the roller 9*g* of the first paper dust removing roller 9*b* is identical to the width of a roller 10*g* of a second paper dust removing roller 10*b* described later, but smaller than the width of a roller 11*g* of a third paper dust removing roller 11*b* described later, and slightly greater than the width B of the pad member 13*b*.

The first paper dust removing roller 9*b* is driven by the first transportation roller 9*a*. The first paper dust removing roller 9*b* is rotatable in the direction indicated by the arrow, that is, the same direction as the paper transportation direction in the part confronting the first transportation path 43 (counterclockwise direction in FIGS. 1 and 2). The first paper dust removing roller 9*b* transports the paper 3 pinched between the first transportation roller 9*a* and the first paper dust removing roller 9*b* while removing paper dust from the paper 3.

As shown in FIG. 2, the first sponge member 9*c* is composed of a material such as urethane foam that easily charges the first paper dust removing roller 9*b*. The first sponge member 9*c* is positioned beneath the first paper dust removing roller 9*b* and is pressed against the first paper dust removing roller 9*b*, so as to be able to scrape off paper dust at a scraping position 9*c*1. The scraping position 9*c*1 contacts a portion of the first paper dust removing roller 9*b* that is a position at a lower side and an opposite side (farther side) from the first transportation path 43. Thus, the first sponge member 9*c* can scrape off paper dust adhering to the first paper dust removing roller 9*b*. The first sponge member 9*c* also performs frictional charging of the surface of the roller 9*g* of the first paper dust removing roller 9*b* by rubbing against the first paper dust removing roller 9*b*. As shown in FIG. 3(*c*), the width of the first sponge member 9*c* is slightly greater than the width of the roller 9*g* of the first paper dust removing roller 9*b*.

The second transportation section 10 is disposed downstream in the paper transportation direction with respect to the first transportation section 9 above the first transportation section 9. The second transportation section 10 is located downstream of the junction position M1 of the first transportation path 43 and the downstream end of the retransportation path 53. Further, the second transportation section 10 is located slightly downstream of the junction position M2 of the first transportation path 43 and the second transportation path 44. The second transportation section 10 includes a second transportation roller 10*a* that transports the paper 3, the second paper dust removing roller 10*b* located so as to confront the same surface as the surface confronting a multipurpose separation pad 15*b* described later, and a second sponge member 10*c* below the second paper dust removing roller 10*b*.

The second transportation roller 10*a* confronts the transportation path 46 from the outer side. The second transportation roller 10*a* has a metallic roller shaft 10*d* covered with a rubber roller be. The second transportation roller 10*a* is rotatable in the direction indicated by the arrow (counterclockwise direction in FIGS. 1 and 2) by the power transmitted from a motor (not shown).

The second paper dust removing roller 10*b* confronts the transportation path 46 from the inner side. The second paper dust removing roller 10*b* has a metallic roller shaft 10*f* covered with the resin roller 10*g* whose surface is easily charged, such as a roller of fluororesin or a roller with a fluororesin coated surface. As shown in FIG. 3(*c*), the second paper dust removing roller 10*b* is positioned in an approximately center position with respect to the second transportation roller 10*a*, such that the second paper dust removing roller 10*b* overlaps the pickup roller 12*a* and the separation roller 12*b* in the paper transportation direction. Accordingly, the second paper dust removing roller 10*b* can contact the surface of the paper 3 that has contacted the pickup roller 12*a* and the separation roller 12*b* (the surface opposite to the image formation surface). More specifically, the second paper dust removing roller 10*b* can contact a part that has contacted the pickup roller 12*a* and the separation roller 12*b* (the approximately center part). As described above, the width of the roller 10*g* of the second paper dust removing roller 10*b* is identical to the width of the roller 9*g* of the first paper dust removing roller 9*b*, but smaller than the width of the roller 11*g* of the third paper dust removing roller 11*b* described later, and slightly greater than the width of the pickup roller 12*a* and the separation roller 12*b*.

The second paper dust removing roller 10*b* is driven by the second transportation roller 10*a*. The second paper dust removing roller 10*b* is rotatable in the direction indicated by the arrow, that is, the same direction as the paper transportation direction in the part confronting the transportation path 46 (clockwise direction in FIGS. 1 and 2). The second paper dust removing roller 10*b* transports the paper 3 pinched between the second transportation roller 10*a* and the second paper dust removing roller 10*b* while removing paper dust from the paper 3.

The second sponge member 10*c* is made of a material that easily charges the second paper dust removing roller 10*b*, such as urethane foam. As shown in FIG. 2, the second sponge member 10*c* is positioned beneath the second paper dust removing roller 10*b*. The second sponge member 10*c* is pressed against the second paper dust removing roller 10*b*, so as to be able to scrape off paper dust on a lower side of the second paper dust removing roller 10*b* that is opposite from the transportation path 46. Thus, the second sponge member 10*c* can scrape off paper dust adhering to the second paper dust removing roller 10*b*. The second sponge member 10*c* also performs frictional charging of the surface of the roller 10*g* of the second paper dust removing roller 10*b* by rubbing against the second paper dust removing roller 10*b*. As shown in FIG. 3(*c*), the width of the second sponge member 10*c* is slightly greater than the width of the roller 10*g* of the second paper dust removing roller 10*b*.

As shown in FIG. 2, the third transportation section 11 is disposed downstream of the second transportation section 10 in the transportation path 46. The third transportation section 11 is located in the vicinity of the second transportation section 10. The third transportation section 11 includes a third transportation roller 11*a* that transports the paper 3, the third paper dust removing roller 11*b* disposed to sandwich the transportation path 46 and to confront the third transportation roller 11*a*, and a third sponge member 11*c* above the third paper dust removing roller 11*b*.

The third transportation roller 11*a* confronts the transportation path 46 from the inner side. The third transportation roller 11*a* has a metallic roller shaft 11*d* covered with a rubber roller 11*e*. The third transportation roller 11*a* is rotatable in the direction indicated by the arrow (clockwise direction in FIGS. 1 and 2) by the power transmitted from a motor (not shown).

The third paper dust removing roller 11*b* confronts the transportation path 46 from the outer side. The third paper dust removing roller 11*b* has a metallic roller shaft 11*f* covered with the resin roller 11*g* whose surface is easily charged, such as a roller of fluororesin or a roller with a fluororesin coated surface. As shown in FIG. 3(*b*), with the third paper dust removing roller 11*b*, the width of the roller 11*g* is slightly greater than the width A of the paper 3, so as to be contactable with the entire surface of the paper 3. In addition, the third paper dust removing roller 11*b* contacts the entirety of the surface that has contacted the pad member 13*b* (the image formation surface that will contact the photosensitive drum 23).

As shown in FIG. 2, the third paper dust removing roller 11*b* is rotatable in the direction indicated by the arrow, that is, the same direction as the paper transportation direction in the part confronting the transportation path 46 (counterclockwise direction in FIGS. 1 and 2). The third paper dust removing roller 11*b* transports the paper 3 pinched between the third transportation roller 11*a* and the third paper dust removing roller 11*b* while removing paper dust from the paper 3.

The third sponge member 11*c* is composed of a material that easily charges the third paper dust removing roller 11*b*, such as urethane foam. The third sponge member 11*c* is positioned above the third paper dust removing roller 11*b*. The third sponge member 11*c* is pressed against the third paper dust removing roller 11*b*, so as to scrape off paper dust at an upper side of the third paper dust removing roller 11*b*, which is an opposite side from the transportation path 46. Thus, the third sponge member 11*c* can scrape off paper dust adhering to the third paper dust removing roller 11*b*. The third sponge member 11*c* also performs frictional charging of the surface of the roller 11*g* of the third paper dust removing roller 11*b* by rubbing against the third paper dust removing roller 11*b*. As shown in FIG. 3(*b*), the width of the third sponge member 11*c* is slightly greater than the width of the third paper dust removing roller 11*b*.

As shown in FIGS. 2 and 4, the paper dust transportation section 60 includes a receiving surface 61 and an auger member 62. The receiving surface 61 receives paper dust scraped by the third sponge member 11*c*. The auger member 62 has an approximately cylindrical shape and transports the paper dust to the storage tank 71. The paper dust transportation section 60 is constituted as a unit that can be inserted into and removed from the laser printer 1.

The receiving surface 61 is formed into a curved concave shape for receiving the auger member 62. The receiving surface 61 is slightly wider than the width of the third paper dust removing roller 11*b*.

As shown in FIG. 4, the auger member 62 includes a shaft 63, and a first spiral member 64 and a second spiral member 65 both formed in a spiral shape around the shaft 63.

The first spiral member 64 is formed along the axial direction on an approximately half portion of the shaft 63. The first spiral member 64 transports paper dust in one s direction (the direction indicated by arrow X) along the axial direction of the third paper dust removing roller 11*b* through rotation of the shaft 63. The second spiral member 65 is formed along the axial direction on the other approximately half portion of the shaft 63 on the side opposite to the side on which the first spiral member 64 is formed. The second spiral member 65 transports paper dust in the other direction. (the direction indicated by arrow Y) along the axial direction of the third paper dust removing roller 11*b* through rotation of the shaft 63.

With the above-described construction, paper dust received on the receiving surface 61 is transported to both ends of the axial direction (in the directions of the arrow X and the arrow Y) by the first spiral member 64 and the second spiral member 65. The paper dust is dropped into and accumulated in the storage tank 71 located below the third transportation section 11.

As shown in FIG. 1, in the laser printer 1, the reverse transportation path 41, the retransportation path 53, the first transportation path 43, and the paper output path 42 jointly form a closed path for supplying the image forming section 5 with the paper 3 that has passed through the image forming section 5 with front and back sides thereof reversed. In other words, the reverse transportation path 41 forms a part of the closed path. The storage tank 71 is located within the closed path. An opening of the storage tank 71 is located below both the second paper dust removing roller 10*b* and the third paper dust removing roller 11*b*. Accordingly, the storage tank 71 can receive both paper dust removed by the second transportation section 10 and paper dust removed by the third transportation section 11.

In the laser printer 1, the paper 3 stacked in a pile in the paper feed tray 6 is separated and fed one sheet at a time by the cooperative action of the separation roller 12*b* and the separation pad 13. At the time of the paper feeding, a large amount of paper dust is generated on the image formation surface due to friction with the separation pad 13. However, when the paper 3 is first transported to the first transportation section 9, and is pinched between the first transportation roller 9*a* and the first paper dust removing roller 9*b*, the image formation surface comes into contact with the roller 9*g* of the first paper dust removing roller 9*b*. The first paper dust removing roller 9*b* is slightly wider than the width of the separation pad 13. Thus, paper dust generated on the paper 3 due to friction with the separation pad 13 is scraped off and electrostatically adsorbed by the roller 9*g* of the first paper dust removing roller 9*b*, because the paper dust generated on the paper 3 has a width approximately equal to the width of the pad s member 13*b* and because the width of the resin roller 9*g* is greater than the width B of the pad member 13*b*. Then, when the paper dust adhering to the roller 9*g* of the first paper dust removing roller 9*b* next confronts the first sponge member 9*c* through the rotation of the first paper dust removing roller 9*b*, the paper dust is scraped off by the first sponge member 9*c*, and falls into and is accumulated in a storage tank 72.

A large amount of paper dust is also generated on the opposite surface that is opposite to the image formation surface due to friction with the pickup roller 12*a* and the separation roller 12*b* during the paper feeding. However, when the paper 3 is transported to the second transportation section 10, and pinched between the second transportation roller 10*a* and the second paper dust removing roller 10*b*, the opposite surface comes into contact with the roller 10*g* of the second paper dust removing roller 10*b*. The second paper dust removing roller 10*b* is slightly wider than the width of the pickup roller 12*a* and the separation roller 12*b*. Thus, paper dust generated on the paper 3 due to friction with the pickup roller 12*a* and the separation roller 12*b* is scraped off and electrostatically adsorbed by the roller 10*g* of the second paper dust removing roller 10*b*, because the paper dust generated on the paper 3 has a width approximately equal to the width of the pickup roller 12*a* and the separation roller 12*b* and because the width of the roller 10*g* is greater than the width of the pickup roller 12*a* and the separation roller 12*b*. Then, when the paper dust adhering to the roller 10*g* of the second paper dust removing roller 10*b* next confronts the second sponge member 10*c* through the rotation of the second paper dust removing roller 10*b*, the paper dust is scraped off by the second sponge member 10*c*, and falls into and is accumulated in the storage tank 71.

Then, when the paper 3 is transported to the third transportation section 11, and pinched between the third transportation roller 11*a* and the third paper dust removing roller 11*b*, the image formation surface comes into contact with the roller 11*g* of the third paper dust removing roller 11*b*. At this time, since the third paper dust removing roller 11*b* is slightly wider than the width of the paper 3, paper dust originally generated on the entirety of the paper 3 during cutting of the paper 3 and so forth, and paper dust remaining after removal by the first paper dust removing roller 9*b*, is scraped off and electrostatically adsorbed by the roller 11*g* of the third paper dust removing roller 11*b*. Then, when the paper dust adhering to the roller 11*g* of the third paper dust removing roller 11*b* next confronts the third sponge member 11*c* through the rotation of the third paper dust removing roller 11*b*, the paper dust is scraped off by the third sponge member 11*c*. The scraped-off paper dust is received by the receiving surface 61, and then, through the rotation of the auger member 62, is transported to through-holes 66 at both ends of the axial direction (in the directions of the arrow X and the arrow Y), and is dropped into and accumulated in the storage tank 71 located below the third transportation section 11.

Thus, in the laser printer 1, before the paper 3 fed by the paper feed mechanism section 7 reaches the image forming section 5, part of paper dust corresponding to the width B of the pad member 13*b* is removed by the first paper dust removing roller 9*b*, part of paper dust corresponding to the width of the pickup roller 12*a* and the separation roller 12*b* is removed by the second paper dust removing roller 10*b*, and part of the paper dust corresponding to the width A of the paper 3 is removed by the third paper dust removing roller 11*b*.

Accordingly, a greater amount of paper dust generated by friction with the pad member 13*b* is removed by the first paper dust removing roller 9*b* and the third paper dust removing roller 11*b*, and a smaller amount of paper dust originally generated on the entirety of the paper 3 during cutting of the paper 3 and so forth is removed by the third paper dust removing roller 11*b*. Also, paper dust generated by friction between the pickup roller 12*a* and the separation roller 12*b* is removed by the second paper dust removing roller 10*b*. As a result, the first transportation section 9, the second transportation section 10, and the third transportation section 11 can remove paper dust generated on the image formation surface due to friction with the pad member 13*b* and paper dust originally generated, in a well-balanced manner, and can achieve uniform paper dust removal with little unevenness of removal. Moreover, the first transportation section 9, the second transportation section 10, and the third transportation section 11 also can remove paper dust generated due to friction between the pickup roller 12*a* and the separation roller 12*b* on the opposite surface to the image formation surface, and can prevent dispersion of paper dust inside the laser printer 1. Thus, the laser printer 1 can prevent contamination of the image forming section 5 due to paper dust effectively, and can form high-quality images.

As the third paper dust removing roller 11*b* is located downstream of the first paper dust removing roller 9*b* in the paper transportation direction, a greater amount of paper dust produced by friction with the pad member 13*b* is first removed by the first paper dust removing roller 9*b*, after which a smaller amount of paper dust originally produced over the entire paper 3 during cutting of the paper 3 and so forth is additionally removed by the third paper dust removing roller 11*b*. Thus, the laser printer 1 can achieve efficient paper dust removal based on differences in the amount of paper dust, enabling more uniform paper dust removal.

The third paper dust removing roller 11*b* has a width greater than the width of the paper 3, while the first paper dust removing roller 9*b* has a width greater than the width of the separation pad. 13 and less than the width of the third paper dust removing roller 11*b*. Therefore, the first paper dust removing roller 9*b* is not wider than necessary, allowing costs to be reduced while enabling paper dust to be removed in a well-balanced manner.

As described above, in the laser printer 1, the first paper dust removing roller 9*b* is located at a predetermined distance from the separation roller 12*b*, and is located downstream in the paper transportation direction, so as not to come into contact with the separation roller 12*b*.

If the first paper dust removing roller 9*b* is in contact with the separation roller 12*b*, for example, then the paper 3 to be fed next is pulled out slightly following the paper 3 fed before, due to friction between the separation roller 12*b* and the paper 3 fed before. In this case, if a front-end portion of the paper 3 was held between the separation roller 12*b* and the first paper dust removing roller 9*b*, and the laser printer 1 was stopped in that state, the front-end portion of the paper 3 pinched between the separation roller 12*b* and the first paper dust removing roller 9*b* might tend to curl. In such a case, when the paper 3 was next supplied, a paper jam may occur or an imperfect image may be produced on the curled front-end portion.

However, because the first paper dust removing roller 9*b* is located so as not to come into contact with the separation roller 12*b*, even if the paper 3 to be fed next should be pulled out slightly following the previously fed paper 3, the paper 3 will not be held between the separation roller 12*b* and the first paper dust removing roller 9*b*. Thus, curling of the front-end portion of the paper 3 can be prevented. Accordingly, the laser printer 1 can achieve satisfactory paper feeding at all times while also performing good paper dust removal.

In the first transportation section 9, the second transportation section 10, and the third transportation section 11, because the first sponge member 9*c* for scraping off paper dust adhering to the first paper dust removing roller 9*b* is provided to confront the first paper dust removing roller 9*b*, the second sponge member 10*c* for scraping off paper dust adhering to the second paper dust removing roller 10*b* is provided to confront the second paper dust removing roller 10*b*, and the third sponge member 11*c* for scraping off paper dust adhering to the third paper dust removing roller 11*b* is provided to confront the third paper dust removing roller 11*b*, paper dust adhering to the first paper dust removing roller 9*b*, the second paper dust removing roller 10*b*, and the third paper dust removing 10 roller 11*b* are scraped off by the first sponge member 9*c*, the second sponge member 10*c*, and the third sponge member 11*c*, respectively. Thus, the paper dust removal capability of the first paper dust removing roller 9*b*, the second paper dust removing roller 10*b*, and the third paper dust removing roller 11*b* can be maintained, and good paper dust removal over a long period can be achieved.

As described above, the widths of the first sponge member 9*c*, the second sponge member 10*c*, and the third sponge member 11*c* are formed so as to be slightly greater than the widths of the first paper dust removing roller 9*b*, the second paper dust removing roller 10*b*, and the third paper dust removing roller 11*b*, respectively. Accordingly, paper dust can be scraped satisfactorily even if paper dust on the paper 3 spreads slightly in the width direction due to contact with the first paper dust removing roller 9*b*, the second paper dust removing roller 10*b*, and the third paper dust removing roller 11*b*.

In the laser printer 1, the paper 3 fed by the paper feed mechanism section 7 is first pinched between the first paper dust removing roller 9*b* and the first transportation roller 9*a* and transported while paper dust is removed, then pinched between the second paper dust removing roller 10*b* and the second transportation roller 10*a* and transported while paper dust is removed, and then further pinched between the third paper dust removing roller 11*b* and the third transportation roller 11*a* and transported while paper dust is removed. The paper 3 can be transported smoothly to the image forming section 5 while paper dust can be removed in a well-balanced manner.

The third paper dust removing roller 11*b* is not driven by the third transportation roller 11*a*, but instead motive power is input to the third paper dust removing roller 11*b* from a separate motor (not shown) via an input gear 11*h*, enabling the third paper dust removing roller 11*b* to be driven by itself. Thus, even if torque load due to contact with the paper 3 and the third sponge member 11*c* is applied to the entirety of the roller 11*g* of the third paper dust removing roller 11*b*, the third paper dust removing roller 11*b* can be rotated smoothly by its own drive force, and good paper dust removal and transportation can be achieved.

The laser printer 1 is provided with the reverse mechanism 37, and the first transportation section 9 is located upstream of the junction position M1 of the retransportation path 53 and the first transportation path 43, while the second transportation section 10 is located downstream of the junction position M1, and the third transportation section 11 is located downstream of the second transportation section 10.

With the above-described construction, since the first paper dust removing roller 9*b* is located upstream of the junction position M1, the first paper dust removing roller 9*b* comes into contact with only the paper 3 fed from the paper feed mechanism section 7. On the other hand, since the second paper dust removing roller 10*b* and the third paper dust removing roller 11*b* are located downstream of the junction position M1, the second paper dust removing roller 10*b* and the third paper dust removing roller 11*b* come into contact with both the paper 3 fed from the paper feed mechanism section 7 and the paper 3 retransported from the retransportation path 53.

Thus, the first paper dust removing roller 9*b* removes only a greater amount of paper dust generated on paper fed from the paper feed mechanism section 7 by friction with the pad member 13*b*, while the second paper dust removing roller 10*b* removes paper dust generated by friction between the pickup roller 12*a* and the separation roller 12*b* and paper dust on the paper 3 retransported from the retransportation path 53. In addition, the third paper dust removing roller 11*b* removes paper dust on the paper 3 fed from the paper feed mechanism section 7 from which the majority of a greater amount of paper dust generated by friction with the pad member 13*b* has already been removed by the first paper dust removing roller 9*b*. The third paper dust removing roller 11*b* also removes paper dust of the paper 3 retransported from the retransportation path 53. Thus, paper dust can be removed effectively according to the amount of paper dust adhering to the paper 3.

The laser printer 1 in the present embodiment is provided with a single first transportation section 9, a single second transportation section 10, and a single third transportation section 11. However, a plurality of each of the first transportation section 9, the second transportation section 10, and the third transportation section 11 may be provided. Alternatively, a plurality of any one of the first transportation section 9, the second transportation section 10, or the third transportation section 11 may be provided.

The first transportation section 9 provided with the first paper dust removing roller 9*b*, the second transportation section 10 provided with the second paper dust removing roller 10*b*, and the third transportation section 11 provided with the third paper dust removing roller 11*b* are located in this order in the paper transportation downstream direction, but the order of the transportation sections 9, 10, and 11 may be changed. For example, the second transportation section 10, the third transportation section 11, and the first transportation section 9 may be disposed in this order in the paper transportation downstream direction.

In this case, because paper dust on the paper 3 spreads slightly in the paper width direction due to contact with the third paper dust removing roller 11*b*, it is desirable that the widths of the first paper dust removing roller 9*b* and the first sponge member 9*c* be greater than the widths in the above-described embodiemnt.

The locations of drive rollers and driven (follow) rollers of the first transportation section 9, the second transportation section 10, and the third transportation section 11 may also be reversed in terms of which is on the inner side and which is on the outer side of the closed path as compared with the above-described embodiment.

As shown in FIG. 1, the laser printer 1 is provided with a multipurpose tray 14 on which the paper 3 of an arbitrary size is stacked, and a multipurpose paper feed mechanism section 15 for feeding the paper 3 stacked in the multipurpose tray 14.

As shown in FIG. 2, the multipurpose paper feed mechanism section 15 includes a multipurpose paper feed roller 15*a* and the multipurpose separation pad 15*b* opposing the multipurpose paper feed roller 15*a*. The multipurpose paper feed mechanism section 15 is disposed at a position along the second transportation path 44. The multipurpose paper feed mechanism section 15 picks up the paper 3 by the multipurpose paper feed roller 15*a*, and separates the paper 3 by contacting the paper 3, so that one sheet of the paper 3 is transported downstream in the second transportation path 44.

The multipurpose separation pad 15*b* includes a supporting frame 15*c*, a multipurpose pad member 15*d*, and a spring 15*e*.

The supporting frame 15*c* has a one end portion 15*c*1 and an other end portion 15*c*2, both of which are formed integrally. The one end portion 15*c*1 is flat plate-shaped. The one end portion 15*c*1 is disposed below the multipurpose paper feed roller 15*a* and confronts the multipurpose paper feed roller 15*a*. The other end portion 15*c*2 has an L-shaped cross section, and is pivotally supported to the main casing 2 by a support shaft 15*c*3, such that the supporting frame 15*c* can be pivotally moved about the support shaft 15*c*3. The multipurpose pad member 15*d* is inset in a concave portion on a side of the one end portion 15*c*1 that confronts the multipurpose paper feed roller 15*a*. The spring 15*e* is disposed on the other side. The spring 15*e* urges the one end portion 15*c*1 such that the multipurpose pad member 15*d* is pressed against the multipurpose paper feed roller 15*a*.

The multipurpose pad member 15*d* has an approximately rectangular plate shape, includes a urethane rubber or similar elastic member, and is formed so that the width of the multipurpose separation pad 15*b* is smaller than the width of the paper 3. In other words, the multipurpose separation pad 15*b* has a width that provides contact with only the widthwise center part of the paper 3 for feeding the paper 3.

Then the topmost paper 3 stacked in the multipurpose tray 14 is pinched between the multipurpose paper feed roller 15*a* and the multipurpose separation pad 15*b* by the rotation of the multipurpose paper feed roller 15*a*, and is separated and fed one sheet at a time by the cooperative action of the multipurpose paper feed roller 15*a* and the multipurpose separation pad 15*b*.

The paper 3 fed from the multipurpose tray 14 passes through the second transportation path 44, and is transported to the second transportation section 10. At this time, as described above, the paper 3 is transported by being pinched between the second transportation roller 10*a* and the second paper dust removing roller 10*b*, and the surface opposite to the image formation surface comes into contact with the roller 10*g* of the second paper dust removing roller 10*b*. At this time, since the second paper dust removing roller 10*b* is slightly wider than the width of the multipurpose separation pad 15*b*, paper dust generated with a width approximately equal to the width of the multipurpose separation pad 15*b* on the paper 3 due to friction with the multipurpose separation pad 15*b* is scraped off and electrostatically adsorbed by the roller 10*g*. Then, when the paper dust adhering to the roller 10*g* next confronts the second sponge member 10*c* through the rotation of the second paper dust removing roller 10*b*, the paper dust is scraped off by the second sponge member 10*c*, and falls into and is accumulated in the storage tank 71.

As described above, paper dust generated with a width approximately equal to the width of the multipurpose separation pad 15*b* on the paper 3 due to friction with the multipurpose separation pad 15*b* is removed satisfactorily from the surface of the paper 3 in the second transportation section 10.

Subsequently, the paper 3 passes further through the transportation path 46, and is transported to the third transportation section 11. At this time, as described above, paper dust originally generated on the entirety of the paper 3 during cutting of the paper 3 and so forth is scraped off and electrostatically adsorbed by the roller 11*g* of the third paper dust removing roller 11*b*. Then, when the paper dust adhering to the roller 11*g* next confronts the third sponge member 11*c* through the rotation of the third paper dust removing roller 11*b*, the paper dust is scraped off by the third sponge member 11*c*. The scraped-off paper dust is received by the receiving surface 61, and then, through the rotation of the auger member 62 (FIG. 4), is transported to the both ends of the axial direction (in the directions of the arrow X and the arrow Y) of the third paper dust removing roller 11*b* by the first spiral member 64 and the second spiral member 65, and is dropped into and accumulated in the storage tank 71 located below the third transportation section 11.

Accordingly, paper dust originally generated on the entirety of the paper 3 during cutting of the paper 3 and so forth is removed satisfactorily from the surface of the paper 3 in the third transportation section 11.

According to the present embodiment, paper dust can be removed across the entire width of the paper 3 whichever transportation path the paper 3 passes through. Therefore, image quality degradation caused by paper dust on the paper 3 is less likely to occur. Also, as paper dust can be removed from parts in contact with the separation pad 13 whichever transportation path the paper 3 passes through, image quality degradation caused by paper dust on the paper 3 is less likely to occur.

Moreover, as paper dust adhering to the paper 3 that has passed through the reverse transportation path 41 can be removed, when images are formed on both sides, quality degradation caused by paper dust on the paper 3 is less likely to occur for both side.

Further, the paper 3 fed from the paper supply cassette 4 passes through the first transportation section 9 provided with the first paper dust removing roller 9*b*, the second transportation section 10 provided with the second paper dust removing roller 10*b*, and the third transportation section 11 provided with the third paper dust removing roller 11*b*, along the first transportation path 43. Thus, the paper dust on the paper 3 passing through the first transportation path 43 is thoroughly removed, and quality degradation of images caused by paper dust on the paper 3 is less likely to occur. On the other hand, the paper 3 fed from the multipurpose tray 14 passes through the second transportation section 10 provided with the second paper dust removing roller 10*b* and the third transportation section 11 provided with the third paper dust removing roller 11*b*, along the second transportation path 44. Thus, the paper dust on the paper 3 passing through the second transportation path 44 is thoroughly removed, and quality degradation caused by the paper dust is less likely to occur.

Further, the storage tank 71 that holds paper dust is disposed inside the closed path that is partly formed by the reverse transportation path 41, and is located below the second transportation section 10 and the third transportation section 11. Thus, because it is not necessary to provide two separate storage tanks for the second transportation section 10 and the third transportation section 11, a space can be used effectively, and the laser printer 1 can be made smaller. In addition, costs can be reduced through a reduction in the number of component parts.

In the above-described embodiment, the storage tank 71 is located below the second transportation section 10 and the third transportation section 11, and can hold dust scraped off and dropped by both the second paper dust removing roller 10*b* and the third paper dust removing roller 11*b*. However, tanks may be provided separately for the second transportation section 10 and the third transportation section 11.

While the invention has been described in detail with reference to the specific embodiment thereof, it would be apparent to those skilled in the art that various changes and modifications may be made therein without departing from the spirit of the invention.

For example, the above-described embodiment relates to a laser printer. However, the present invention is not limited to a laser printer and can also be applied to different types of printers such as an ink-jet type printer, an image reading device, or another device having the same kind of transportation paths as the above-described embodiment.

Further, in the above-described embodiment, the laser printer 1 has a reverse transportation path. However, the laser printer may be a printer that does not have a reverse transportation path.

What is claimed is:

1. An image forming device comprising:

an image forming section forming an image on an image formation surface of a recording medium, the recording medium having a width in a widthwise direction orthogonal to a recording-medium transportation direction;

a plurality of recording-medium supply units each supplying the image forming section with the recoding medium;

a transportation guide forming a plurality of transportation paths, each transportation path connecting a corresponding one of the plurality of recording-medium supply units to the image forming section, the recording medium being transported from each recording-medium supply unit to the image forming section in the recording-medium transportation direction, each of the plurality of transportation paths joining together to provide a single main transportation path before reaching the image forming section, the single main transportation path being a path through which the recording mediums supplied from all of the plurality of recording-medium supply units are transported;

a full-width cleaning member disposed in the single main transportation path, the full-width cleaning member being contactable with the image formation surface of the recording medium, the full-width cleaning member having a full-width cleaning portion for removing foreign matter adhering to the image formation surface of the recording medium, the full-width cleaning portion having a first width greater than the width of the recording medium in the widthwise direction;

a plurality of recording-medium separating members each disposed at a position, in each of the plurality of transportation paths, between a corresponding recording-medium supply unit and the full-width cleaning member, each recording-medium separating member being contactable with one surface of the recording medium, thereby separating only one sheet of the recording medium to be transported downstream, each recording-medium separating member having a second width in the widthwise direction smaller than the width of the recording medium; and at least one partial cleaning member provided for each recording-medium separating member, the at least one partial cleaning member being disposed at a position, in a corresponding transportation path, between a corresponding recording-medium separating member and the image forming section, each partial cleaning member being contactable with the one surface of the recording medium, each partial cleaning member having a partial cleaning portion for removing foreign matter adhering to the one surface of the recording medium, the partial cleaning portion having a third width greater than the second width of the corresponding recording-medium separating member.

2. The image forming device as claimed in claim 1, further comprising a reverse guide that forms a reverse transportation path for supplying the image forming section with the recording medium that has passed through the image forming section with front and back sides thereof reversed:

wherein the plurality of transportation paths includes a first transportation path and a second transportation path;

wherein the reverse transportation path joins with the first transportation path at a first junction position;

wherein the first transportation path and the second transportation path join with each other at a second junction position to provide the single main transportation path, the second junction position being positioned downstream of the first junction position; and wherein the full-width cleaning member is positioned in the single main transportation path between the second junction position and the image forming section.

3. The image forming device as claimed in claim 1, further comprising a reverse guide that forms a reverse transportation path for supplying the image forming section with the recording medium that has passed through the image forming section with front and back sides thereof reversed;

wherein the reverse transportation path joins with one of the plurality of transportation paths at a position upstream of both the full-width cleaning member and at least the partial cleaning member located nearest to the full-width cleaning member.

4. The image forming device as claimed in claim 3, further comprising a storage tank storing the foreign matter removed from the recording medium by the full-width cleaning member;

wherein the reverse transportation path forms a part of a closed path for supplying the image forming section with the recording medium that has passed through the image forming section with front and back sides thereof reversed; and wherein the storage tank is disposed inside the closed path.

5. The image forming device as claimed in claim 1, further comprising a rotation member provided for each recording-medium separating member, the rotation member having a surface with a coefficient of friction that is higher than a coefficient of friction of the recording-medium separating member, the rotation member transporting the recording medium downstream by pinching the recording medium in cooperation with the recording-medium separating member.

6. The image forming device as claimed in claim 1, wherein the plurality of recording-medium supply units includes a recording-medium feed tray and a recording-medium supply cassette, the recording-medium supply cassette being capable of accommodating a plurality of recording media in a stacked form.

7. The image forming device as claimed in claim 1, wherein the plurality of transportation paths includes a first transportation path and a second transportation path, the first and second transportation paths joining with each other at a predetermined junction position to provide the single main transportation path;

wherein, in the first transportation path, the at least one partial cleaning member is disposed upstream of the predetermined junction position; and wherein, in the second transportation path, the at least one partial cleaning member is disposed downstream of the predetermined junction position.

8. The image forming device as claimed in claim 7, wherein the recording medium has a first surface and a second surface opposite to the first surface;

wherein the at least one partial cleaning member provided in the first transportation path is disposed to confront the first surface; and wherein the at least one partial cleaning member provided in the second transportation path is disposed to confront the second surface.

9. The image forming device as claimed in claim 7, wherein the plurality of recording-medium supply units includes a recording-medium feed tray and a recording-medium supply cassette, the recording-medium supply cassette being capable of accommodating a plurality of recording media in a stacked form;

wherein the first transportation path connects the recording-medium supply cassette to the image forming section; and wherein the second transportation path connects the recording-medium feed tray to the image forming section.

10. The image forming device as claimed in claim 1, further comprising a storage tank storing the foreign matter removed from the recording medium by the full-width cleaning member.

11. The image forming device as claimed in claim 10, wherein the storage tank stores both the foreign matter removed from the recording medium by the full-width cleaning member and the foreign matter removed from the recording medium by at least one of the partial cleaning members.

12. The image forming device as claimed in claim 1, wherein the image forming section includes:

a light source emitting a light beam;

an image bearing member on which an electrostatic latent image is formed by the light beam emitted from the light source;

a developing section developing, with developer, the electrostatic latent image formed on the image bearing member and forming a developed image; and a transfer section transferring the developed image formed on the image bearing member to the recording medium.

13. The image forming device as claimed in claim 1, wherein the third width is smaller than the first width.

14. An image forming device comprising:

an image forming section forming an image on an image formation surface of a recording medium, the recording medium having a width in a widthwise direction orthogonal to a recording-medium transportation direction;

a plurality of recording-medium supply units each supplying the image forming section with the recoding medium;

a transportation guide forming a plurality of transportation paths, each transportation path connecting a corresponding one of the plurality of recording-medium supply units to the image forming section, the recording medium being transported from each recording-medium supply unit to the image forming section in the recording-medium transportation direction, each of the plurality of transportation paths joining together to provide a single main transportation path before reaching the image forming section;

a full-width cleaning member disposed in the single main transportation path at a position downstream from all of the plurality of recording-medium supply units, the full-width cleaning member being contactable with the image formation surface of the recording medium, the full-width cleaning member having a full-width cleaning portion for removing foreign matter adhering to the image formation surface of the recording medium, the full-width cleaning portion having a first width greater than the width of the recording medium in the widthwise direction;

a plurality of recording-medium separating members each disposed at a position, in each of the plurality of transportation paths, between a corresponding recording-medium supply unit and the full-width cleaning member, each recording-medium separating member being contactable with one surface of the recording medium, thereby separating only one sheet of the recording medium to be transported downstream, each recording-medium separating member having a second width in the widthwise direction smaller than the width of the recording medium; and at least one partial cleaning member provided for each recording-medium separating member, the at least one partial cleaning member being disposed at a position, in a corresponding transportation path, between a corresponding recording-medium separating member and the image forming section, each partial cleaning member being contactable with the one surface of the recording medium, each partial cleaning member having a partial cleaning portion for removing foreign matter adhering to the one surface of the recording medium, the partial cleaning portion having a third width greater than the second width of the corresponding recording-medium separating member.

* * * * *